US012139820B2

(12) United States Patent
Xu et al.

(10) Patent No.: US 12,139,820 B2
(45) Date of Patent: Nov. 12, 2024

(54) ELECTROSPINNING APPARATUS FOR FABRICATING NANOFIBER OF CORE-SHELL STRUCTURE

(71) Applicant: SOOCHOW UNIVERSITY, Suzhou (CN)

(72) Inventors: Lan Xu, Suzhou (CN); Dong Wei, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 439 days.

(21) Appl. No.: 17/628,514

(22) PCT Filed: Jun. 29, 2021

(86) PCT No.: PCT/CN2021/102984
§ 371 (c)(1),
(2) Date: Jan. 19, 2022

(87) PCT Pub. No.: WO2022/205638
PCT Pub. Date: Oct. 6, 2022

(65) Prior Publication Data

US 2023/0313416 A1 Oct. 5, 2023

(30) Foreign Application Priority Data

Mar. 29, 2021 (CN) ..... 202110335317.0

(51) Int. Cl.
*D01D 5/00* (2006.01)
*D01D 4/02* (2006.01)

(52) U.S. Cl.
CPC ..... *D01D 5/0069* (2013.01); *D01D 4/02* (2013.01)

(58) Field of Classification Search
CPC ..... D01D 5/0069; D01D 4/02; D01D 5/34; D01D 5/0061; D01D 5/003
See application file for complete search history.

(56) References Cited

U.S. PATENT DOCUMENTS

2006/0226580 A1 10/2006 Xia et al.

FOREIGN PATENT DOCUMENTS

CN 102864503 A * 1/2013
CN 105755556 A * 7/2016 ..... D01D 5/0069
(Continued)

OTHER PUBLICATIONS

CN-102864503-A (Year: 2013).*
KR 20140124562 A (Year: 2014).*
CN-105755556-A (Year: 2016).*

*Primary Examiner* — Jeffrey M Wollschlager
*Assistant Examiner* — Guy F Mongelli
(74) *Attorney, Agent, or Firm* — SZDC Law PC

(57) ABSTRACT

The present provides an electrospinning apparatus for fabricating a nanofiber of core-shell structure, including a high-voltage electrostatic generator, a frame and a liquid brusher. A horizontally moving means is connected to the frame, and the horizontally moving means is connected with the liquid brusher. A chain-drive mechanism and a first reservoir are provided below the liquid brusher, the chain-drive mechanism includes a first sprocket and a second sprocket, and a chain is connected between the first sprocket and the second sprocket. The chain is engaged with a spray sprocket, and the spray sprocket is connected with a first motor via a revolving shaft. A core solution is contained in the first reservoir, and the lower portion of the spray sprocket is immersed in the core solution. The horizontally moving means drives the liquid brusher to move along the chain, and the liquid brusher brushes the shell solution over the chain.

9 Claims, 1 Drawing Sheet

(56) References Cited

FOREIGN PATENT DOCUMENTS

| | | | | |
|---|---|---|---|---|
| CN | 205874599 | U | | 1/2017 |
| CN | 110295399 | A | | 10/2019 |
| CN | 111472057 | A | | 7/2020 |
| CN | 112609249 | A | | 4/2021 |
| CN | 112921417 | A | | 6/2021 |
| KR | 20140124562 | A | * | 10/2014 |

* cited by examiner

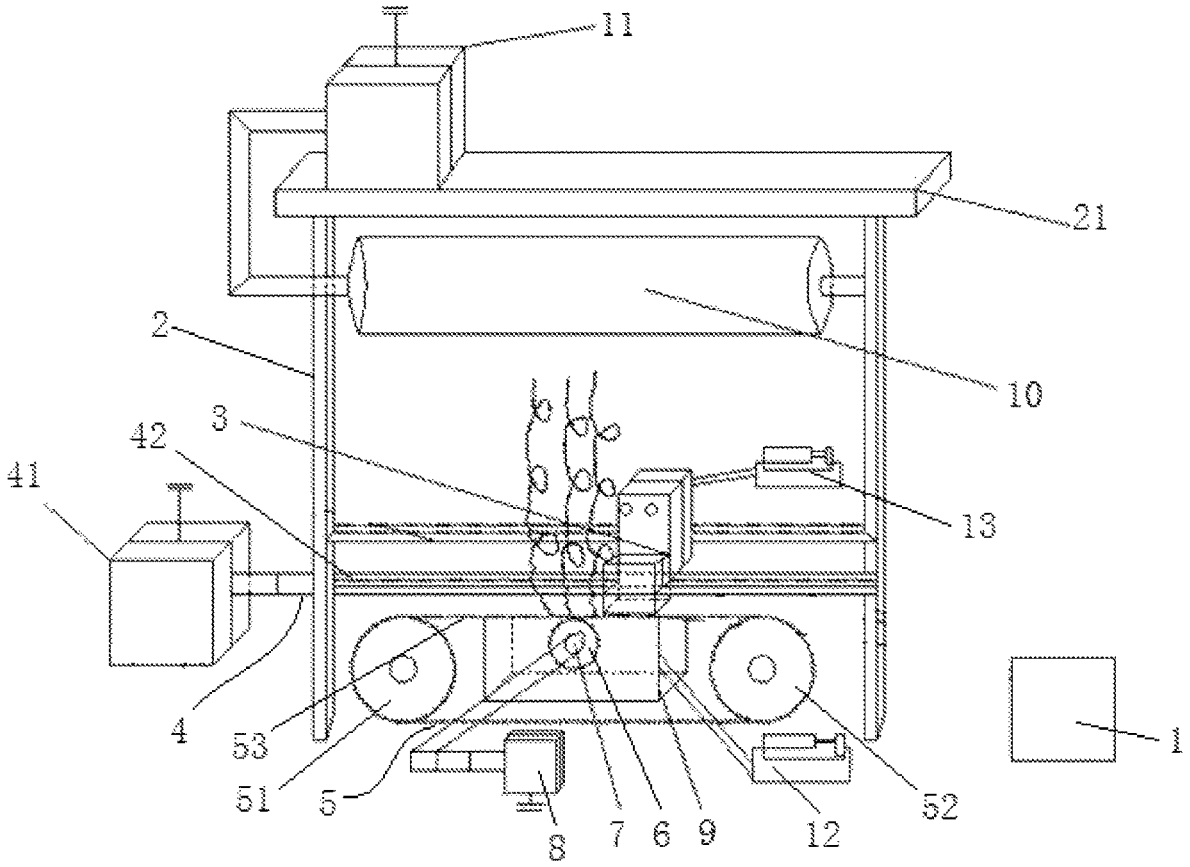
11
21
2
10
3
42
41
13
4
53
51
5
8
7
6
9
12
52
1

ELECTROSPINNING APPARATUS FOR FABRICATING NANOFIBER OF CORE-SHELL STRUCTURE

This application is the National Stage Application of PCT/CN2021/102984, filed on Jun. 29, 2021, which claims priority to Chinese Patent Application No. 202110335317.0, filed on Mar. 29, 2021, which is incorporated by reference for all purposes as if fully set forth herein.

FIELD OF THE INVENTION

The present invention relates to the technical field of electrospinning, and more particularly to an electrospinning apparatus for fabricating a nanofiber of core-shell structure.

DESCRIPTION OF THE RELATED ART

Electrospinning technology uses electric field force to draw polymer solution or melt out of a capillary mouth to form a jet, and after swinging, evaporation and refined evaporation, a nano-scale fiber is finally obtained. Electrospinning technology has become one of the main ways to efficiently prepare nanofiber materials due to its advantages of simple manufacturing equipment, low spinning cost, wide variety of spinnable materials and process controllability.

The nanofiber of core-shell structure includes a core and a shell coated on the core. The shell and the core can be made of different types of fibers. Compared with the nanofiber of mono structure, the nanofiber of core-shell structure has better physical and chemical properties, and has potential application value in the fields of materials science, chemistry, magnetism, electricity, optics, biomedicine and catalysis, etc. However, existing electrospinning apparatuses are inconvenient for preparing nanofibers of core-shell structure and consequently cannot meet use requirements.

SUMMARY OF THE INVENTION

In view of this, the present invention is intended to overcome the inconvenience of an electrospinning apparatus from prior art for preparing a nanofiber of core-shell structure.

To solve the technical problem mentioned above, the present invention provides an electrospinning apparatus for fabricating a nanofiber of core-shell structure, including a high-voltage electrostatic generator, a frame and a liquid brusher, a horizontally moving means is connected to the frame, the horizontally moving means is connected with the liquid brusher, a chain-drive mechanism and a first reservoir are provided below the liquid brusher, the chain-drive mechanism including a first sprocket and a second sprocket, a chain is connected between the first sprocket and the second sprocket, the chain is engaged with a spray sprocket, the spray sprocket is connected with a first motor via a revolving shaft, a core solution is contained in the first reservoir, a lower portion of the spray sprocket is immersed in the core solution, the horizontally moving means is configured to drive the liquid brusher to move along the chain, the liquid brusher is configured to brush a shell solution over the chain.

In an embodiment of the present invention, the tooth of the spray sprocket is provided with a reservoir hole.

In an embodiment of the present invention, the reservoir hole is provided at the top of the tooth of the spray sprocket.

In an embodiment of the present invention, a roller is connected to the frame, the roller is driven by a second motor to rotate and positioned above the liquid brusher.

In an embodiment of the present invention, a mounting platform is connected to the upper portion of the frame, and the second motor is connected to the mounting platform.

In an embodiment of the present invention, the horizontally moving means is a lead-screw-nut driving means including a lead screw and a driving nut that is axially movable along the lead screw, the lead screw is horizontally arranged, the lead screw is rotatably connected to the frame, the lead screw is driven by a third motor to rotate, the driving nut is connected with the liquid brusher.

In an embodiment of the present invention, the first reservoir is connected with a first supply pump.

In an embodiment of the present invention, the liquid brusher is connected with a second reservoir via a second supply pump.

In an embodiment of the present invention, the first reservoir is provided with a shaft hole, the revolving shaft is connected with the shaft hole via a bearing.

In an embodiment of the present invention, the high-voltage electrostatic generator is a high-voltage power supply.

As compared with prior art, the technical solution of the present invention has the following advantages.

The electrospinning apparatus for fabricating a nanofiber of core-shell structure according to the present invention can effectively prepare a nanofiber of core-shell structure and is conveniently operable and has high preparation efficiency.

BRIEF DESCRIPTION OF THE DRAWINGS

To provide clear understanding of the present invention, the present invention will be described in further detail below according to the specific embodiments of the present invention in conjunction with the accompanying drawings, in which FIG. 1 is a schematic view of an electrospinning apparatus for preparing a nanofiber of core-shell structure according to the present invention.

REFERENCE NUMERALS

1. high-voltage electrostatic generator; 2 frame; 21 mounting platform; 3 liquid brusher; 4 horizontally moving means; 41 third motor; 42 lead screw; 5 chain-drive mechanism; 51 first sprocket; 52 second sprocket; 53 chain; 6 spray sprocket; 7 revolving shaft; 8 first motor; 9 first reservoir; 10 roller; 11 second motor; 12 first supply pump; 13 second supply pump.

DETAILED DESCRIPTION OF THE PREFERRED EMBODIMENTS

The present invention will be further explained below with reference to the drawings and particular embodiments, so that those skilled in the art can better understand and implement the present invention, but the listed embodiments are not intended as limitations of the present invention.

With reference to FIG. 1, this embodiment provides an electrospinning apparatus for preparing a nanofiber of core-shell structure, including a high-voltage electrostatic generator 1, a frame 2 and a liquid brusher 3. A horizontally moving means 4 is connected on the frame 2. The horizontally moving means 4 is connected with the liquid brusher 3. A chain-drive mechanism 5 and a first reservoir 9 are provided below the liquid brusher 3. The chain-drive mechanism 5 includes a first sprocket 51 and a second sprocket 52. A chain 53 is connected between the first sprocket 51 and the second sprocket 52. The chain 53 is engaged with a spray sprocket 6. The spray sprocket 6 is connected with the first motor 8 via a revolving shaft 7. Core solution is contained in the first reservoir 9 for forming core fibers. The lower portion of the spray sprocket 6 is immersed in the core solution. The horizontally moving means 4 is configured to drive the liquid brusher 3 to move along the chain 53. The liquid brusher 3 is configured to brush shell solution over the chain 53. The core solution is used for forming core fibers.

The high-voltage electrostatic generator 1 is configured to generate an electrostatic field. It is the basic configuration of the electrospinning apparatus to enable the surfaces of the core solution and the shell solution to aggregate charges due to induction from the electric field, so that the sprayed liquid can finally be drawn down rapidly to form nano-scale fibers under effect of the high electric field.

In one embodiment, the teeth of the spray sprocket 6 are provided with a reservoir hole that can temporarily store the core solution to facilitate spraying of the core solution. Preferably, each tooth of the spray sprocket 6 can be provided with a reservoir hole.

In one embodiment, the reservoir hole is arranged at the top of the tooth of the spray sprocket 6 to provide better liquid storage and spray effect.

In one embodiment, a roller 10 is connected to the frame 2. The roller 10 is driven by a second motor 11 to rotate. The roller 10 is positioned above the liquid brusher 3 to store the nanofibers of core-shell structure. Furthermore, the continuously rotating roller 10 can wind the nanofibers tangled together and draw them parallel to each other.

In one embodiment, a mounting platform 21 is connected on the upper portion of the frame 2. A second motor 11 is connected on the mounting platform 21 to improve the mounting stability of the second motor 11.

In one embodiment, the horizontally moving means 4 is a lead-screw-nut driving means. The lead-screw-nut driving means includes a lead screw 42 and a driving nut that is axially movable along the lead screw 42. The lead screw 42 is horizontally arranged. The lead screw 42 is rotatably connected to the frame 2. The lead screw 42 is driven by a third motor 41 to rotate. The driving nut is connected with the liquid brusher 3. The lead-screw-nut driving means mentioned above has desirable driving stability and can be conveniently controlled.

As can be understood, the horizontally moving means 4 is not limited to the structure described above, and it may alternatively be another device that can drive the liquid brusher 3 to move along the chain 53.

In one embodiment, the first reservoir 9 is connected with the first supply pump 12 to supply the core solution to the first reservoir 9 more efficiently.

In one embodiment, the liquid brusher 3 is connected with the second reservoir (not shown) via the second supply pump 13 to supply the shell solution to the liquid brusher 3 in time.

In one embodiment, the first reservoir 9 is provided with a shaft hole. The revolving shaft is connected with the shaft hole via a bearing.

In one embodiment, the high-voltage electrostatic generator 1 is a high-voltage power supply.

In this embodiment, the working process of the electrospinning apparatus for fabricating a nanofiber of core-shell structure is as follows. The high-voltage electrostatic generator 1 is turned on so that the electrospinning apparatus in the electrostatic field. Then the first motor 8 drives the spray sprocket 6 to rotate. The spray sprocket 6 drives the chain 53 to move, so that the chain-drive mechanism 5 runs to ensure continuous transmission of the chain 53. Furthermore, as the lower portion of the spray sprocket 6 is immersed in the core solution inside the first reservoir 9, the spray sprocket 6 brings the core solution up during rotation to spray it towards the chain 53. The core solution is rapidly drawn down to form core fibers during spraying under effect of the high electric field. The liquid brusher 3 is driven by the horizontally moving means 4 to move along the chain 53 and continuously brush the shell solution over the chain 53 during movement. Likewise, the shell solution forms shell fibers under the effect of the high electric effect. In this way, when the core fiber passes through the chain hole in the chain 53, the shell fiber is cladded over the core fiber, thereby forming a nanofiber of core-shell structure. This nanofiber of core-shell structure continues to move upward till it is wound on the roller 10 above.

The conventional electrospinning apparatus, generally consisting of a high-voltage power supply, a container with a spinning jet and a receiving polar plate, has low spinning efficiency, whereas the electrospinning apparatus for fabricating a nanofiber of core-shell structure in this embodiment can significantly improve the electrospinning efficiency, thereby facilitating bulk preparation of nanofibers from electrospinning.

The electrospinning apparatus for fabricating a nanofiber of core-shell structure in this embodiment can efficiently prepare a nanofiber of core-shell structure. The fiber of core-shell structure thus prepared has a uniform fiber structure with intact cladding. The apparatus has a simple overall structure and is conveniently operable, thereby having the potential of popularization and application.

Obviously, the embodiments described above are merely examples listed for the purpose of clear explanation, and are not intended as limitation of the implementations. For those of ordinary skill in the art, other changes or variations in different forms can be made on the basis of the above description. It is not necessary and not possible to exhaust all the implementations here. The obvious changes or variations derived therefrom shall fall within the scope of protection created by the present invention.

What is claimed is:

1. An electrospinning apparatus for fabricating a nanofiber of core-shell structure, comprising: an electrostatic generator, a frame and a liquid brusher, a horizontally moving means being connected on the frame, the horizontally moving means being connected with the liquid brusher, a chain-drive mechanism and a first reservoir being provided below the liquid brusher, the chain-drive mechanism including a first sprocket and a second sprocket, a chain being connected between the first sprocket and the second sprocket, the chain being engaged with a spray sprocket, the spray sprocket being connected to a first motor via a revolving shaft, a core solution being contained in the first reservoir, a lower portion of the spray sprocket being immersed in the core solution, the horizontally moving means being configured to drive the liquid brusher to move along the chain, the liquid brusher being configured to brush a shell solution over the chain, wherein a tooth of the spray sprocket is provided with a reservoir hole.

2. The electrospinning apparatus for fabricating a nanofiber of core-shell structure of claim 1, wherein the reservoir hole is provided at the top of the tooth of the spray sprocket.

3. The electrospinning apparatus for fabricating a nanofiber of core-shell structure of claim 1, wherein a roller is connected on the frame, the roller being driven by a second motor to rotate and positioned above the liquid brusher.

4. The electrospinning apparatus for fabricating a nanofiber of core-shell structure of claim 3, wherein a mounting platform is connected on an upper portion of the frame, the second motor being connected on the mounting platform.

5. The electrospinning apparatus for fabricating a nanofiber of core-shell structure of claim 1, wherein the horizontally moving means is a lead-screw-nut driving means including a lead screw and a driving nut that is axially movable along the lead screw, the lead screw being horizontally arranged, the lead screw being rotatably connected to the frame, the lead screw being driven by a third motor to rotate, the driving nut being connected with the liquid brusher.

6. The electrospinning apparatus for fabricating a nanofiber of core-shell structure of claim 1, wherein the first reservoir is connected with a first supply pump.

7. The electrospinning apparatus for fabricating a nanofiber of core-shell structure of claim 1, wherein the liquid brusher is connected with a second reservoir via a second supply pump.

8. The electrospinning apparatus for fabricating a nanofiber of core-shell structure of claim 1, wherein the first reservoir is provided with a shaft hole, the revolving shaft being connected with the shaft hole via a bearing.

9. The electrospinning apparatus for fabricating a nanofiber of core-shell structure of claim 1, wherein the electrostatic generator is a power supply.

* * * * *